United States Patent [19]

Hölzl

[11] Patent Number: 4,611,672

[45] Date of Patent: Sep. 16, 1986

[54] DRILL BIT

[75] Inventor: Kurt Hölzl, Leoben, Austria

[73] Assignee: Vereinigte Edelstahlwerke Aktiengesellschaft, Vienna, Austria

[21] Appl. No.: 621,867

[22] Filed: Jun. 18, 1984

[51] Int. Cl.[4] ..... E21B 10/18

[52] U.S. Cl. ..... 175/339; 175/67

[58] Field of Search ..... 175/339, 422, 340, 393, 175/65, 67

[56] References Cited

U.S. PATENT DOCUMENTS

| | | | |
|---|---|---|---|
| 2,950,090 | 8/1960 | Swart | 175/340 |
| 3,179,189 | 4/1965 | Goodwin | 175/340 |
| 3,207,241 | 9/1965 | Neilson | 175/350 |
| 3,389,759 | 6/1968 | Mori et al. | 175/422 |
| 3,645,346 | 2/1972 | Miller et al. | 175/340 |
| 3,688,853 | 9/1972 | Maurer et al. | 175/340 X |
| 4,185,706 | 1/1980 | Baker, III et al. | 175/67 X |
| 4,306,627 | 12/1981 | Cheung et al. | 175/67 X |

*Primary Examiner*—Stephen J. Novosad
*Assistant Examiner*—Thuy M. Bui
*Attorney, Agent, or Firm*—Werner W. Kleeman

[57] ABSTRACT

A drilling bit, such as a crenellated drilling bit for fluid-jet supported rotary drilling in rock comprises a nozzle for directing a jet of high-pressure fluid against rock material being bored. In addition to transporting away rock chips, the jet penetrates fissures in the rock and supports the breaking down of the rock structure by the drilling bit. Since such nozzles tend to wear more rapidly than the cutting edges of the drilling bit, a readily exchangeable nozzle insert is provided. The nozzle insert is seated in a retaining body incorporated in the drilling bit and is held in the retaining body by a threaded annular cap. The annular cap has a hexagonal recess for accommodating a tool such as an Allan-key.

13 Claims, 3 Drawing Figures

DRILL BIT

BACKGROUND OF THE INVENTION

The present invention broadly relates to a drilling bit, and, more specifically pertains to a new and improved crenellated drilling bit for the fluid-jet supported drilling of rock.

Generally speaking, the drilling bit of the present invention is for liquid-jet supported, especially rotary, drilling in rock and comprises hard-metal tipped cutting edges, pins or the like with at least one means of supply for a fluid pressure medium having a pressure between 500 and 4,000 bar which opens into at least one nozzle releasably installed in the drilling bit body.

In other words, the present invention relates to a drilling bit, such as a crenellated drilling bit for fluid-jet supported rotary drilling in rock which comprises a drilling bit body having cutting elements tipped with hard-metal, at least one nozzle member releasably installed in the drilling bit body, at least one supply channel for a fluid pressure medium provided in the drilling bit body and opening into the nozzle member, and the fluid pressure medium having a pressure of between 500 and 4,000 bar.

Drilling bits, whether for impact or pure rotary drilling in rock, must fulfill diverse objectives. The rock can be subject to relatively high pressure-loading, while on the other hand the tensile strength of rock is usually low. The drilling bit serves as a force-transmitting element between the drilling machine and the rock. The rock is initially elastically deformed by the effect of the forces of the drilling bit, especially of the cutting edges, while compressive cracks and shear cracks simultaneously arise in the rock. Rock particles must simultaneously be dislodged from the crystal structure of the rock and transported away from the immediate effective region of the cutting edges. Such elimination must be performed in order that the energy supplied by the boring machine not be employed to further reduce the drilling chips, which would build up a cushion between the rock to be removed and the drill cutting edges.

It is known to employ fluids, especially gases or liquids, to transport the drilling chips away. The liquids can also comprise suspension materials, in order that specifically denser substances can be transported out of the bore hole. Such flushing fluids, however, do not serve to support the removal of solid rock.

In water-jet supported cutting, the water-jet enters into cracks, fissures and the like, which already exist or which arise due to the effect of the forces of the drilling bit upon the rock, and loosens the rock structure, so that a supplemental material-removal effect can be attributed to the liquid jet, which is most commonly a water-jet. This effect arises as a rule at a pressure between 500 and 4,000 bar.

It is important for the effect of the high-pressure-medium jets that the jet can cooperate with the cutting edges of the drilling bit, i.e. that the jets be directed to those locations or regions of the rock where the cracks arise. Upon considering that there is an intimate interaction between crack growth and the arrangement of cutting edges on the drilling bit, then the great importance of exact orientation of the liquid jet or jets becomes particularly clear.

The liquid jets exit from the drilling bits through nozzles which may, for instance, be constructed of corundum and comprise an exit aperture which is only a fraction of a millimeter. Since the jets, as a rule, have a lower service life than the drilling bits per se, these jets are preferably removably attached to the drilling bit.

It is already known to fasten a disc-shaped nozzle in a drilling bit for fluid-jet supported drilling by a union nut which has a slot for turning with a screwdriver. This permits performing the replacement of the delicate nozzles with coarse tools, but an exact positioning of the nozzle as well as an optimum sealing, which would avoid a corresponding pressure loss, is usually no longer guaranteed after replacement of the nozzles.

SUMMARY OF THE INVENTION

Therefore, with the foregoing in mind, it is a primary object of the present invention to provide a new and improved construction of a drilling bit which does not exhibit the aforementioned drawbacks and shortcomings of the prior art constructions.

Another and more specific object of the present invention aims at providing a new and improved construction of a drilling bit for fluid-jet supported, especially rotary, drilling in rock in which the nozzles for the fluid jet, especially water jet, are exactly positioned and wherein the exact same water-jet direction is achieved as before replacement when replacing these nozzles.

Yet a further significant object of the present invention aims at providing a new and improved construction of a drilling bit of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the drilling bit of the present invention is manifested by the features that the nozzle is constructed with a nozzle insert and with a retainer body extending longitudinally in the jet direction and wherein the retainer body is releasably retained in a recess, especially a bore, of the drilling bit body by an annular body. Due to the fact that the nozzle insert is contained in a retainer body extending longitudinally in the jet direction, the retainer body can be retained exactly over or in alignment with the annular body in the recess of the drilling bit body, so that an exact and reproducible fixation of the nozzle insert and therefore of the high-pressure jet is achieved, wherein a replacement of the jet can also be performed with simply manipulatable tools, if necessary in situ.

In other words, the drilling bit of the present invention is manifested by the features that it defines a fluid-jet direction and comprises a nozzle insert and a retaining body which conjointly define the nozzle member, the retaining body extending longitudinally in the fluid-jet direction. A recess is provided in the drilling bit body and the drilling bit comprises an annular body releasably retaining the retaining body in the recess.

If the retainer body comprises at least one rotationally symmetrical guide surface which intimately contacts a correspondingly constructed guide surface of the annular body, then a particularly accurate and exact positioning can be achieved. If the retainer body comprises a cylindrical extension, such as a shank, which intimately contacts a cylindrical recess in the annular body, an embodiment results which is particularly simple to fabricate and can therefore be especially accurately fabricated.

If the cylindrical extension or shank comprises a recess extending in the longitudinal direction of the cylindrical extension or shank for the passage of an already bundled liquid jet, then the actually effective component of the nozzle, i.e. the nozzle insert, is particularly well protected against mechanical damage, while a randomly selectable cross section of the fluid conduit before the nozzle insert is also achieved so that any unnecessary pressure loss can be avoided.

A particularly simple replacability of the nozzle is achieved when the annular body comprises an external thread and the recess in the drilling bit body comprises an appropriate internal thread.

A safe repetitive employment of the annular body is achieved when the latter comprises a polygonal configuration, especially an internal polygonal configuration.

If the recess in the drilling bit body comprises a conical seat for the retaining body of the nozzle insert, then a self-adjustment in particularly advantageous manner is achieved.

If a sealing ring or gasket is provided in a ring-shaped recess between the seat in the recess of the drilling bit body and the retainer component for the nozzle, then a particularly durable sealing with low application of force and therefore low deformation of the seat can be effected.

A particularly simple variation of the nozzle body results when the annular recess for the sealing ring is provided in the seat of the recess in the drilling bit body.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
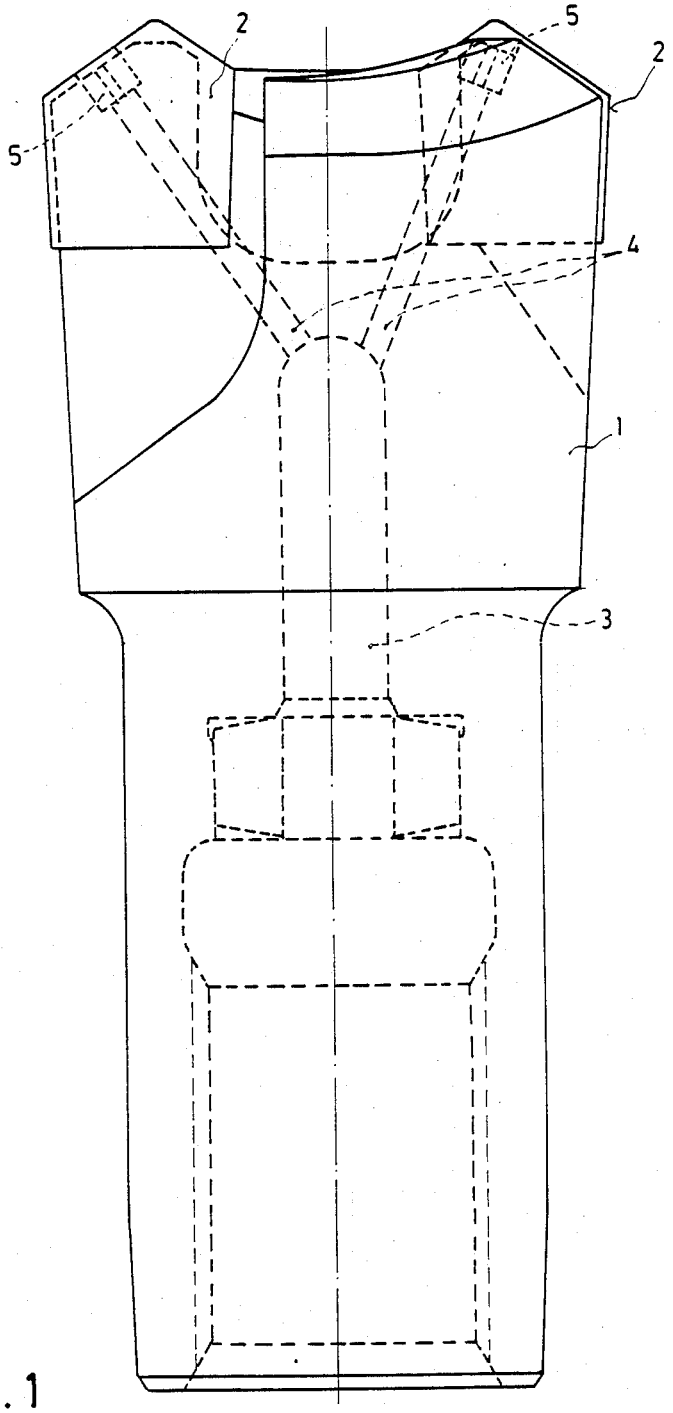
FIG. 1 shows a crenellated drilling bit in side view.

Describing now the drawings, it is to be understood that to simplify the showing thereof only enough of the structure of the drilling bit has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a drilling bit body 1 which is provided with cutting edges 2 made of hard-metal. Diamonds embedded in the drilling bit material or other cutting edge inserts can be provided in place of the cutting edges. The drilling bit body further comprises a supply channel or conduit 3 for the fluid pressure medium, e.g. water. This supply channel or conduit 3 branches into several supply channels or conduits 4, only two of which are shown, which open into schematically represented nozzles 5.

Figure 2:
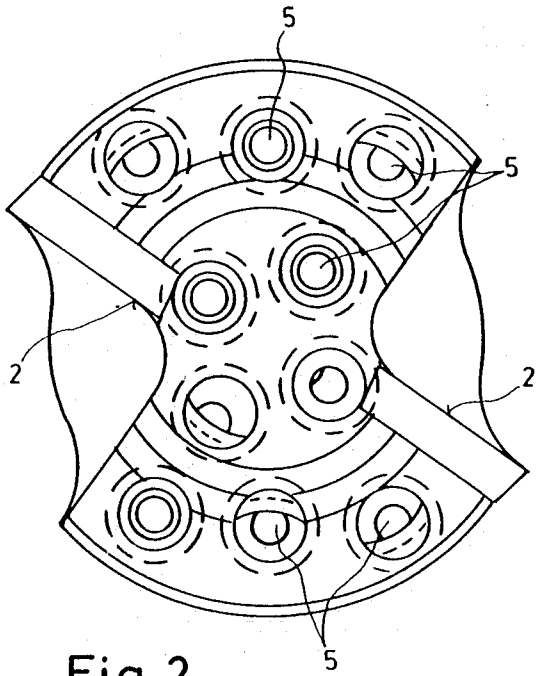
FIG. 2 shows a drilling bit in plan view.

As can be seen from FIG. 2, which shows a plan view of the drilling bit according to FIG. 1, the nozzles 5 are arranged in a definite or predetermined relation to the cutting edges 2.

Figure 3:
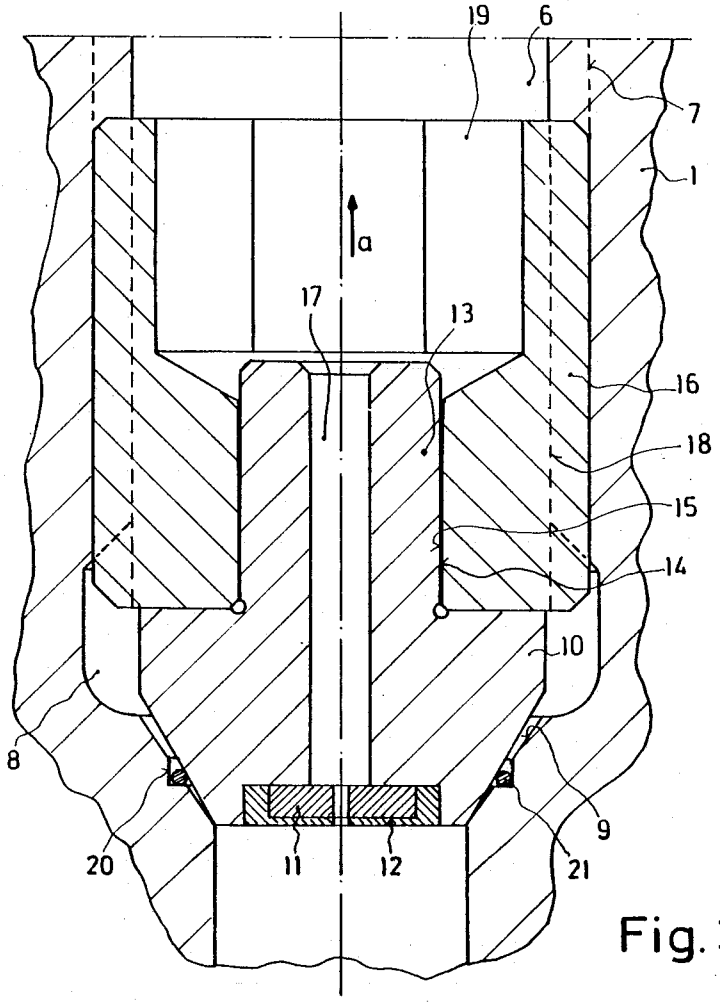
FIG. 3 shows a section through a nozzle in the drilling bit.

A recess 6 in the drilling bit body 1 is shown in FIG. 3 which comprises an internal thread 7. This recess 6 comprises an annular or ring-shaped extension 8 at its bottom which makes a transition to a conical seat 9. The water-jet exits as a bundled fluid-jet in the direction of the arrow a. A retainer body 10 with a nozzle insert 11 is provided in the recess 6, wherein the nozzle insert 11 is fixedly arranged in a cylindrical recess of the retainer body 10, e.g. by means of a plastic mass 12.

The retainer body 10 comprises a cylindrical shaft or shank 13 having a cylindrical guide surface 14 which cooperates with a cylindrical guide surface 15 of an annular or ring-shaped body 16. The retainer body 10 comprises a recess 17 extending in the longitudinal direction and through which the water-jet exits in the direction of the arrow a. As can be seen, the exit aperture of the nozzle insert is considerably smaller than the free cross-section of this recess 17.

The annular body 16 comprises an external thread 18 which cooperates with the internal thread 7. The annular body further comprises a hexagonal configuration 19 on the end of the drilling bit oriented toward the free surface which serves to engage a suitable Allen key or the like.

An annular groove 20 is provided in the conical seat 9 in which a sealing ring or gasket 21 is arranged. Drilling tools having cutting rollers, pins, corundum impregnated or diamond-impregnated cutting edges or the like are examples of alternate types of drilling tools.

While there are shown and described present preferred embodiments of the invention, it is to be distinctly understood that the invention is not limited thereto, but may be otherwise variously embodied and practiced within the scope of the following claims.

Accordingly, I claim:

1. A drilling bit for fluid-jet supported rotary drilling in rock, comprising:

a drilling bit body having cutting elements tipped with hard-metal, said cutting elements being fixed with respect to said drilling bit body;

at least one nozzle member releasably installed in said drilling bit body;

said at least one nozzle member having an exit aperture of less than 1 mm diameter;

at least one supply channel for a fluid pressure medium provided in said drilling bit body and opening into said at least one nozzle member;

means for providing a fluid pressure flow having a pressure of between 500 and 4,000 bar;

the drilling bit defining a fluid-jet direction;

a nozzle insert and a retaining body conjointly defining said at least one nozzle member;

said retaining body extending longitudinally in said fluid-jet direction and comprising a reduced diameter portion providing a substantially cylindrical extension, said cylindrical extension forming a cylindrical guide surface on its outer periphery;

said drilling bit body having a recess;

an annular body releasably retaining said retaining body in said recess of said drilling bit body; and said annular body comprising a substantially cylindrical recess forming a cylindrical guide surface on said annular body, said cylindrical guide surface on said annular body cooperating with the cylindrical guide surface on the cylindrical extension of said retaining body whereby said nozzle may be accurately positioned with respect to said cutting elements.

2. The drilling bit as defined in claim 1, wherein:
said cutting elements comprise cutting edges.

3. The drilling bit as defined in claim 1, wherein:
said cutting elements comprise cutting pins.

4. The drilling bit as defined in claim 1, wherein:
said recess comprises a bore.

5. The drilling bit as defined in claim 1, wherein:
said cylindrical guide surface on the cylindrical extension of said retaining body being in intimate contact with the cylindrical guide surface of said cylindrical recess of said annular body.

6. The drilling bit as defined in claim 1, wherein:
said cylindrical extension is a shank.

7. The drilling bit as defined in claim 6, wherein:
said shank has a longitudinal direction of extent; and
said shank comprising a recess extending in said longitudinal direction of extent of said shank for transmitting a bundled fluid-jet of said pressure fluid medium.

8. The drilling bit as defined in claim 1, wherein:
said annular body comprises an external thread;
said recess of the drilling bit body being provided with an internal thread; and
said external thread engaging said internal thread.

9. The drilling bit as defined in claim 1, wherein:
said annular body possesses a polygonal configuration.

10. The drilling bit as defined in claim 9, wherein:
said polygonal configuration is an internal polygonal configuration.

11. The drilling bit as defined in claim 1, wherein:
said recess of the drilling bit body possesses a substantially conical seat for said retaining body.

12. The drilling bit as defined in claim 11, further including:
an annular groove arranged between said substantially conical seat and said retaining body; and
a sealing ring provided in said annular groove.

13. The drilling bit as defined in claim 12, wherein:
said annular groove is provided in said substantially conical seat.

* * * * *